United States Patent [19]

Hodge

[11] Patent Number: 4,557,401

[45] Date of Patent: Dec. 10, 1985

[54] FLUID CONTAINER SAFETY VALVE

[75] Inventor: John G. Hodge, Seattle, Wash.

[73] Assignee: The Boeing Company, Seattle, Wash.

[21] Appl. No.: 557,078

[22] Filed: Dec. 1, 1983

Related U.S. Application Data

[62] Division of Ser. No. 324,161, Nov. 23, 1981, abandoned.

[51] Int. Cl.[4] ..... B65D 37/00

[52] U.S. Cl. ..... 222/211; 222/213; 137/493.3; 137/493.6

[58] Field of Search ..... 137/493.3–493.6, 137/493.9; 239/327; 222/211–213, 382, 464

[56] References Cited

U.S. PATENT DOCUMENTS 921,085 5/1909 Clark ..... 222/211

2,877,917 3/1959 Brooks et al. ..... 222/464

3,176,883 4/1965 Davis ..... 222/212

3,939,866 2/1976 Pignatelli ..... 137/493.5

*Primary Examiner*—H. Grant Skaggs

*Attorney, Agent, or Firm*—Morris A. Case; B. A. Donahue

[57] ABSTRACT

A control unit for a squeeze type fluid container is attached to a tube extending from inside the container to the outside. The control unit has a check valve resiliently held to open in response to pressure inside the container; which permits fluid to flow through the control unit and out the tube. The control valve has a second check valve positioned inside the first check valve casing, and resiliently held to open in response to a negative pressure inside the container to permit fluid to flow from the tube through the control unit and back into the container.

2 Claims, 5 Drawing Figures

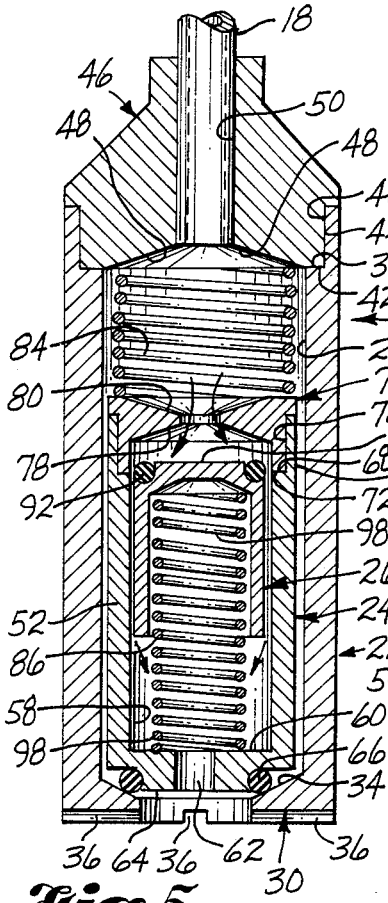
Fig. 5
Fig. 1
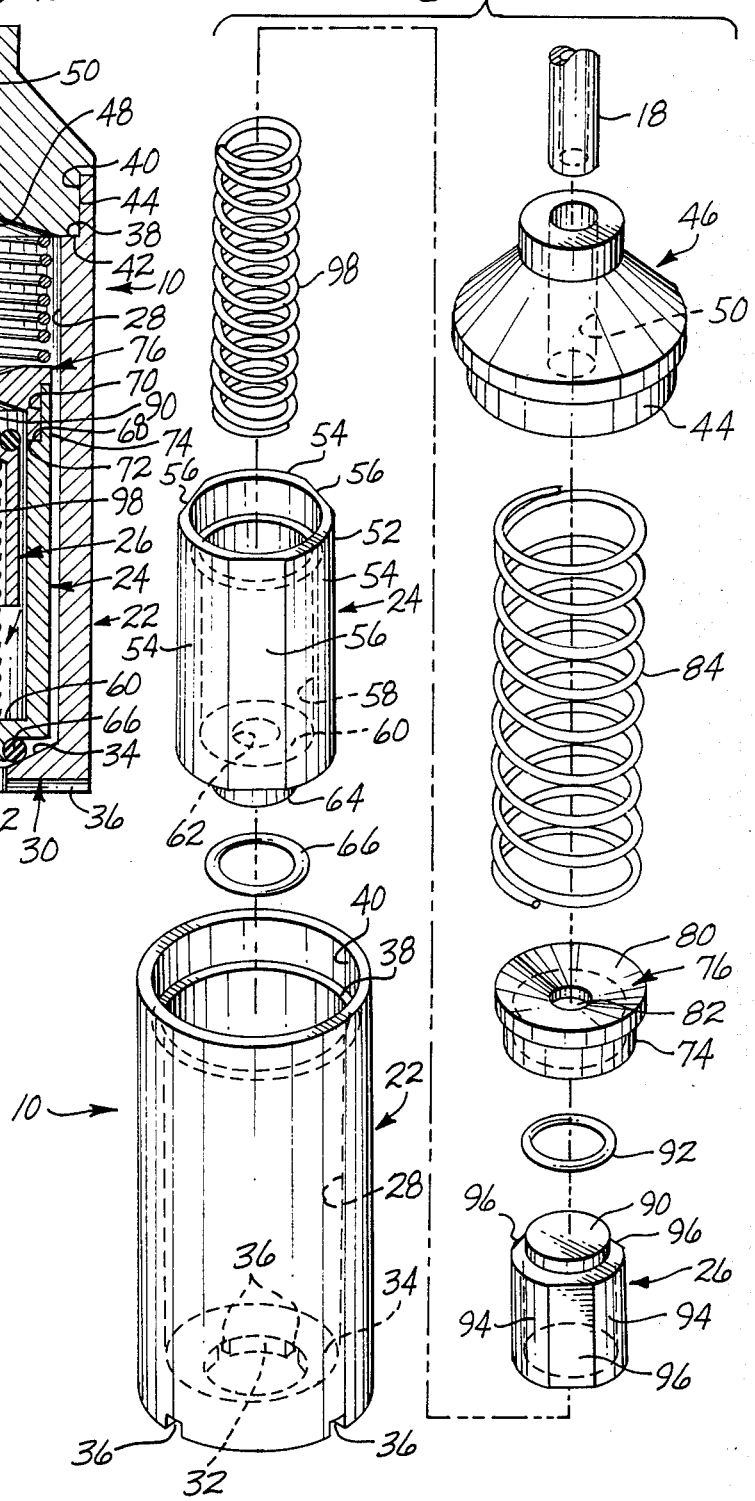

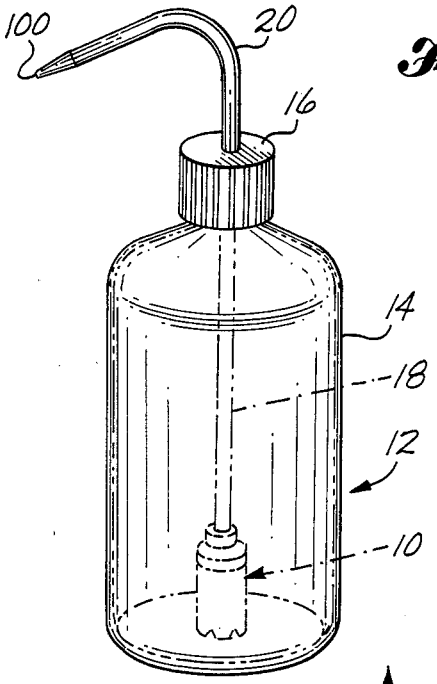
Fig. 2
Fig. 3
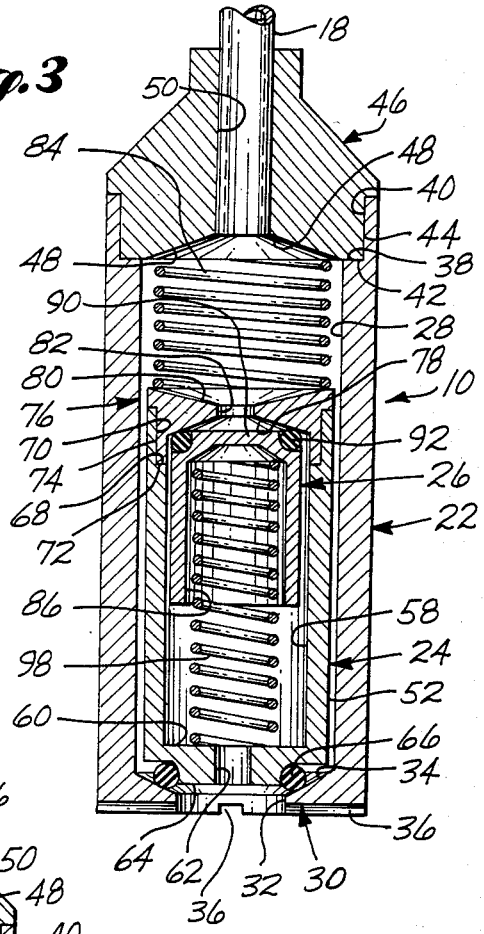
Fig. 4
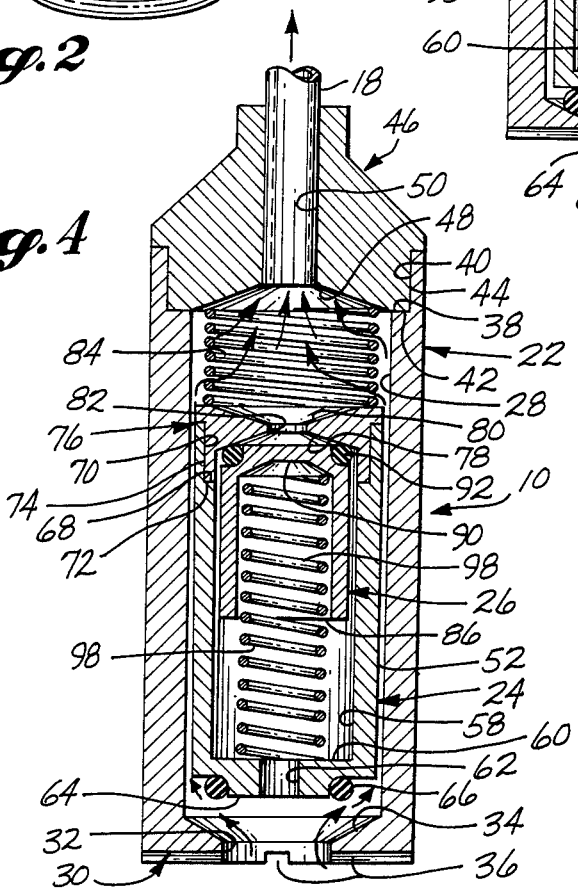

FLUID CONTAINER SAFETY VALVE

This is a division, of application Ser. No. 324,161 filed Nov. 23, 1981, now abandoned.

BACKGROUND OF THE INVENTION

It is frequently desirable to direct a limited amount of fluid onto a workpiece. One of the better devices for dispensing a fluid for this use is known as a "gooseneck" bottle. This simple device uses a flexible container, a tube to extend from near the bottom of the container, through the container cap and along an arc outside the container to aid in diverting the fluid. In use the container is filled with the proper fluid, the container picked up the outside end of the tube directed to the workpiece and the container squeezed to force the fluid through the tube and onto the workpiece. This type of dispenser has one real disadvantage in that it allows the fluid to leak out if it should be tipped over. If the fluid being used is a solvent it could be dangerous.

A dual valve was discovered that could be used in combination with the "gooseneck" bottle to permit proper operation while preventing leakage.

SUMMARY OF THE INVENTION

A housing for a control valve for a squeeze type fluid dispensing container has one end sized to be secured to an end of a tube leading out of the container, and the opposite end of the housing is open ended. A resiliently held check valve mounted inside the housing, when opened, permits flow through the open end into the housing and out the tube. A second resiliently held check valve mounted inside the first check valve, when opened, permits flow from the tube into the housing then through the opening in the housing back into the dispensing container.

DESCRIPTION OF THE DRAWINGS

FIG. 1 shows an exploded perspective view of the control unit of this invention.

FIG. 2 shows a perspective view of the invention of FIG. 1 mounted inside a squeeze type fluid dispensing container.

FIG. 3 shows a side elevational view in section of the control unit with valves closed.

FIG. 4 shows a side elevational sectional view as in FIG. 3 with one of the valves in the control unit opened to permit flow out of the dispensing container.

FIG. 5 shows a side elevational sectional view as in FIG. 3 with another one of the valves in the control unit opened to permit flow back into the dispensing container.

DETAILED DESCRIPTION

A safety valve 10, is used in conjunction with a squeeze type fluid dispenser 12, to control the flow of fluid out of and back into the dispenser in response to pressure, and to release of pressure, on the dispenser; while preventing fluid flow when the dispenser is not activated. The dispenser has a bottle or container 14 that is resilient to permit deformation in response to a squeezing pressure, a bottle cap 16 and a tube or stem 18 that extends from near the bottom of the bottle, sealingly passes through the cap and extends outside preferably with a gooseneck shape 20. The bottle is preferably of a clear plastic to permit viewing the fluid level.

The safety valve 10 is made up with a housing 22, a first check valve 24, mounted inside the housing, and a second check valve 26, mounted inside the first check valve. The housing is shaped like a hollow cylinder with an inside diameter 28, and is open ended at both ends. At one of those ends there is a radially inward extending flange 30, that ends at an axial opening 32. Along the inside of the flange it is tapered in shape at 34, to form a valve seat. On the outside of the flange there are radially directed recesses 36, to permit movement of fluid even if the housing rests on the container. At the opposite end the cylindrical member is completely open ended, and is recessed radially outward to form a shoulder 38 and a diameter 40, that is sized to make a sealing compression fit with surfaces 42 and 44, respectively, of a housing cap 46. The cap has a taper 48, at one end and an axially extending opening 50, sized to make a sealing compression fit with tube 18.

The first check valve 24, has a casing 52 having an outer periphery sized at areas 54, see FIG. 1, to provide a sliding fit along inner diameter 28 of the housing 22. The outer periphery of the casing has lengthwise grooves at 56, to permit flow of fluid between the inside of the housing and the casing. The casing is tubular in shape and has inner diameter 58. One end of the casing extends radially inward at 60, and ends with an axially located opening 62. That extension also has an axially outward extending projection 64; which is sized to accept and hold a resilient O-ring 66; which acts as the valve sealing member. At the opposite end the casing is open ended and is recessed radially outward to form a shoulder 68 and a diameter 70, that is sized to make a sealing compression fit with surfaces 72 and 74 respectively of a casing cap 76. The cap has a narrowing radially inwardly extending projection with inner tapered side 78 that acts as a valve seat, and outer tapered side 80. The projection terminates in an axial opening 82. Resilient member or spring 84 extends from surface 48 of the housing cap 46 to surface 80 of casing cap 76 to continually urge valve 24 closed.

The second valve 26, has a structure that is tubular in shape, is open ended at 86 and the other end 90, not only is completely closed off but it is shaped to accept and hold a resilient O-ring seal 92. The outer periphery of the tubular portion is sized at areas 94, to provide a sliding fit along the inner diameter 58 of the first valve casing. The outer periphery of the tubular structure also has lengthwise grooves 96, to permit flow of fluid between the inside of the casing of the first valve and the structure of the second valve. Resilient member or spring 98 extends from the inside of valve end 90, to inwardly extending member 60 on valve casing 24 to continually urge valve 26 closed.

To assemble O-ring 92 is placed on the structure of the second check valve 26, spring 98 placed inside and the structure with spring inserted inside the first check valve casing 52, and the casing cap 76 pressed into the casing. Next the O-ring seal 66 is placed on the casing which is inserted into the housing 22, the spring 84 also inserted, and the housing cap 46 secured to the housing. The fluid control safety valve 10 is then ready to be placed on the end of tube 18.

In operation the tube 18, with attached safety valve 10, is inserted into a fluid dispensing container 12, and cap 16 tightened to secure the unit to the container. The container is picked up, and the outside end 100 of the tube directed toward a workpiece to be coated with fluid. At this time both valves are closed, as is shown in FIG. 3, and no fluid will flow. To supply fluid the container is squeezed which creates an inside pressure that overcomes spring 84 and the first check valve 24 opens to permit the fluid to flow from the container into the housing around the outside of valve casing and out the tube as is shown in FIG. 4. When pressure is released on the container it starts to return to the presqueezed configuration; which creates a suction inside the container, pulling the first valve closed and overcoming spring 98, to open the second valve and bring fluid and air from the tube into the housing, through the inside of the first valve casing, and back into the container as shown in FIG. 5. Once the container is returned to its original configuration both valves return to the closed position and fluid will not pass through even though the container be tipped onto its side.

I claim:

1. A fluid flow control unit comprising: a squeeze type dispensing container; a container cap; a tube extending through and sealingly joined to the cap, with the tube having a length to extend from a point adjacent the bottom of the container to a point outside the container; a housing one end of which has a hole communicating to the inside with the hole sized to accept and attach to the inside end of the tube and the other end of the housing have a tapered radially inward extending projection that acts as a valve seat and terminates in an axially located opening; a casing slideably mounted inside the housng, with the casing having lengthwise grooves around the outer periphery, radially inward extending ends each terminating in an axially located hole, the lower end on the outside having a valve seal member to mate with the valve seat on the housing and the upper end tapered on the inside to make a valve seat; a resilient member continually urging the casing with valve seal against the valve seat; a tubular member slideably mounted inside the casing, with the tubular member having lengthwise grooves on the outer periphery, open ended at the lower end and closed at the upper end with the upper end having a valve seal on the outside; and a resilient member continually urging the tubular member valve seal against the valve seat on the casing to in combination form a fluid control unit dispensing fluid in response to pressure on the flexible container and returning fluid and air into the container upon releasing the pressure.

2. A fluid flow control unit as in claim 1 further comprising the lower end of the housing having a series of radially directed recesses.

* * * * *